US006042032A

United States Patent [19]

Pinoncely

[11] Patent Number: 6,042,032

[45] Date of Patent: Mar. 28, 2000

[54] METHOD AND APPARATUS FOR SIMULTANEOUSLY AND CONTINUOUSLY PRODUCING A PLURALITY OF SIZE FRACTIONS OF A MINERAL MATERIAL

[75] Inventor: André Pinoncely, Brignais, France

[73] Assignee: FCB Societe Anonyme, Montreuil, France

[21] Appl. No.: 09/155,130

[22] PCT Filed: Mar. 20, 1997

[86] PCT No.: PCT/FR97/00492

§ 371 Date: Sep. 21, 1998

§ 102(e) Date: Sep. 21, 1998

[87] PCT Pub. No.: WO97/35665

PCT Pub. Date: Oct. 2, 1997

[30] Foreign Application Priority Data

Mar. 22, 1996 [FR] France ..... 96 03577

[51] Int. Cl.[7] ..... B02C 23/12

[52] U.S. Cl. ..... 241/24.1; 241/29; 241/79.1; 241/80; 241/97

[58] Field of Search ..... 241/29, 24.15, 241/24.1, 80, 97, 79, 79.1, DIG. 38

[56] References Cited

U.S. PATENT DOCUMENTS

| | | | |
|---|---|---|---|
| 2,072,063 | 2/1937 | Alton | 241/80 |
| 2,461,089 | 2/1949 | Smidth | 241/80 |
| 2,554,450 | 5/1951 | Ayers | 241/80 |
| 5,379,948 | 1/1995 | Teppo | 241/29 |

FOREIGN PATENT DOCUMENTS

| | | |
|---|---|---|
| 0164512 | 3/1985 | European Pat. Off. . |
| 0406591 | 6/1990 | European Pat. Off. . |
| 2344337 | 10/1997 | France . |
| 1194230 | 6/1965 | Germany . |
| 3126871 | 1/1983 | Germany . |
| 2157975 | 11/1985 | United Kingdom . |
| WO 88/01906 | 3/1988 | WIPO . |

OTHER PUBLICATIONS

SALA Mining Equipment, Canadian Mining Journal, Dec. 1960.

*Primary Examiner*—Mark Rosenbaum
*Attorney, Agent, or Firm*—Harrison & Egbert

[57] ABSTRACT

A continuously operating process and a plant for comminuting by grinding a mineral material into grains of different sizes and dividing the ground product into several fractions each constituted by grains the dimensions of which are between a predetermined upper limit and a predetermined lower limit. Starting from a raw product, it is subjected to grinding by material layer crushing, the ground products are divided into several fractions comprising at least one coarse fraction and one fine fraction, and those grains the dimensions of which are greater than the upper limit of the coarse fraction, and possibly all or part of the fractions the grains of which have dimensions between the lower limit of the coarse fraction and the upper limit of the fine fraction, are returned to the grinder input.

8 Claims, 5 Drawing Sheets

METHOD AND APPARATUS FOR SIMULTANEOUSLY AND CONTINUOUSLY PRODUCING A PLURALITY OF SIZE FRACTIONS OF A MINERAL MATERIAL

TECHNICAL FIELD

The invention relates to a process and a continuously operating plant for comminuting a mineral material to grains of different sizes and dividing the ground product into several granulometric fractions each constituted by grains the dimensions of which range between a predetermined upper and a predetermined lower limit.

BACKGROUND ART

In many applications, it is necessary to produce, from a mineral material, grains, the dimensions of which are contained within clearly determined limits. When the grains are relatively large (between one millimeter and several tens of millimeters), it is known to produce them by breaking and to classify them according to different grades by screening. When the starting material has to be comminuted to powder (between one micron and several tens of microns), crushing is carried out, generally after several stages of breaking and grinding, followed by grading, for example by means of one or more pneumatic separators.

To produce relatively large grains and powder simultaneously, at least two comminuting apparatus have to be used: a breaker and a grinder.

The object of the invention is to permit the simultaneous production of several fractions of different grain sizes, ranging from a fraction the grains of which are of a size of possibly up to several tens of millimeters to a fraction the grains of which are of a size in the order of one micron to several hundreds of microns, by means of a single fragmenting apparatus and of grading apparatus.

SUMMARY OF THE INVENTION

The process to which the invention relates is characterized in that, starting from a raw product in the form of pieces, the pieces being, for example, of dimensions less than, or at the most, equal to, 150 mm, the product is subjected to grinding by material layer crushing, the ground products are divided into several fractions comprising at least one coarse fraction the grains of which are of a size ranging, for example, between 0.5 and several tens of millimeters, and a fine fraction having an upper limit ranging, for example, from 300 $\mu$m to several tens of $\mu$m, the parameters of the grinding operation possibly being selected in such a way that, in the case of all the fractions, the throughput produced is greater than, or at least equal to, the throughput desired, and those grains the dimensions of which are above the upper limit of the coarse fraction, and possibly all or part of the fractions the grains of which have dimensions contained between the lower limit of the coarse fraction and the upper limit of the fine fraction, are returned to the input of the grinder.

The fine and coarse fractions are thus directly usable after a single grinding step. As to the intermediate fraction, it can also be sub-divided.

The advantage of grinding by material layer crushing is that it makes it possible, within a single fragmentation step, to produce a mixture having a wide grain size spectrum containing both large-sized grains (ranging, for example, from 0.5 mm to several tens of millimeters) and grains forming powder (the size of which is, for example, less than 300 $\mu$m).

In addition, by choosing to grade or classify the grains obtained, apart from the oversize grains, according to at least three grain size fractions, and by choosing to recycle the grains of the intermediate fraction in preference to those of the coarse fraction, grinding is optimised.

The expression grinding by material layer crushing refers to those grinding processes in which a multi-granular layer of product to be ground is compressed between two surfaces using a pressure that is sufficient to cause fragmentation of the grains, which are comminuted to form smaller grains. The known apparatus for implementing these processes are edge runner type grinders, vertical small ball or pebble grinding mills, ring grinders, roll presses and vibrating cone grinders.

These are, for example, apparatus permitting the application of a fragmenting pressure several times to the material in the course of its processing.

The invention also relates to a plant for implementing the process described above, characterized in that it comprises a grinder carrying out material layer grinding and at least two grading apparatus, one of these apparatus being capable of separating from the products from the grinder those the grain size of which is above the upper limit of the coarse fraction, these being returned to the grinder input, and the other grading apparatus being capable of separating from the ground products the grains forming the fine fraction. In the case of a dry product, one of the grading apparatus will be a screen and the other can be a pneumatic separator. In the case of a wet process, one of the apparatus can be a screen or a hydraulic grading apparatus, and the other can be a hydrocyclone.

These are, for example, external grading apparatus, that is to say apparatus not integrated in the grinder.

DETAILED DESCRIPTION OF THE INVENTION

Figure 1:
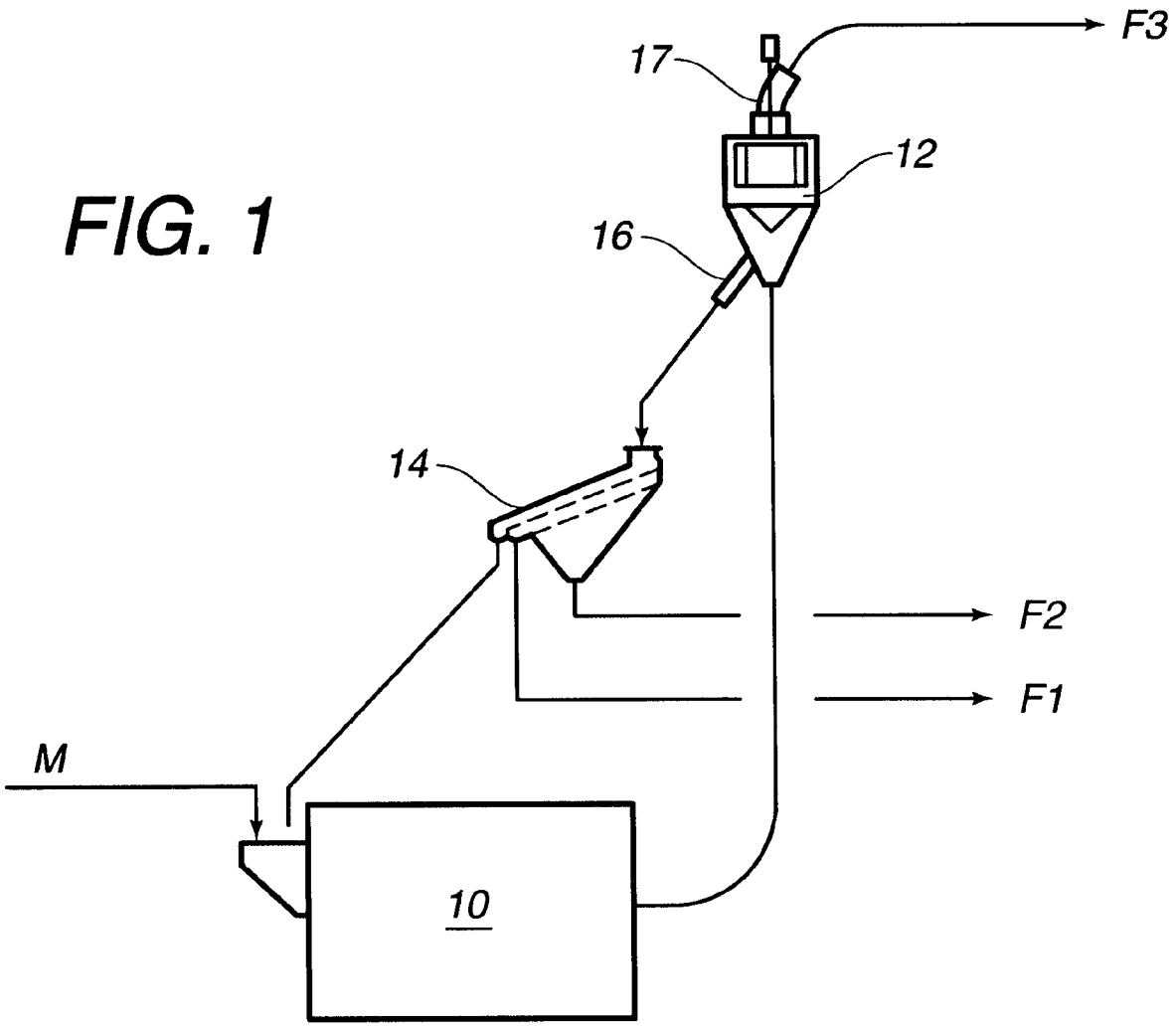
FIG. 1 is a diagrammatic illustration of a simplified form of the present invention.

The diagram of FIG. 1 shows a plant that is simplified and formed essentially by a grinder 10, a pneumatic separator 12 and a screen 14.

The grinder is, for example, a ring grinder of the type described in French patents Nos. 90 14004 and 91 09788. It is formed by a drum having a substantially horizontal axis inside which is provided an annular track on which a roller, the axis of which is parallel to that of the drum, is pressed by springs or jacks. The material for grinding is M introduced into the drum, which rotates at a speed that is sufficiently high (a speed higher than the critical speed) for the material to form over the entire track a layer over which the roller passes. The ground products are discharged and conveyed to the separator 12 by a stream of air or another gas flowing through the drum.

Separator 12 is of the type described in French patent No. 90 01673. It comprises a rotor having a vertical axis, provided with vanes on its periphery and surrounded by vertical fixed, but orientatable, blades. The stream of air laden with the ground product is admitted into the housing of the separator from below, passes from the outside to the inside through the crown or ring of blades, then penetrates the rotor and is finally discharged through a central opening in the rotor. Those grains the dimensions of which are greater than a predetermined dimension (cut-off mesh) are projected by centrifugal force against the blades and drop into the lower part of the housing, from which they are discharged through an output 16. The particles the dimensions of which are less than the cut-off mesh are entrained by the stream of air inside the rotor and discharged with it via an output 17. These form the fine fraction, F3, of the ground product that is separated from the stream of air in a dust collecting filter; their dimensions can vary, for example, from 1 $\mu$m to 100 $\mu$m.

The products discharged via the output 16 of separator 12 feed screen 14. The latter is equipped with 2 cloths or grids enabling the products from the separator 12 to be divided into 3 fractions: the rejects constituted by the largest pieces (for example greater than 10 mm) which are returned to the grinder input, a coarse fraction F1, the dimensions of which are, for example, between 1 and 10 mm, and an intermediate fraction, F2, the dimensions of which are between 0.1 and 1 mm.

Figure 2:
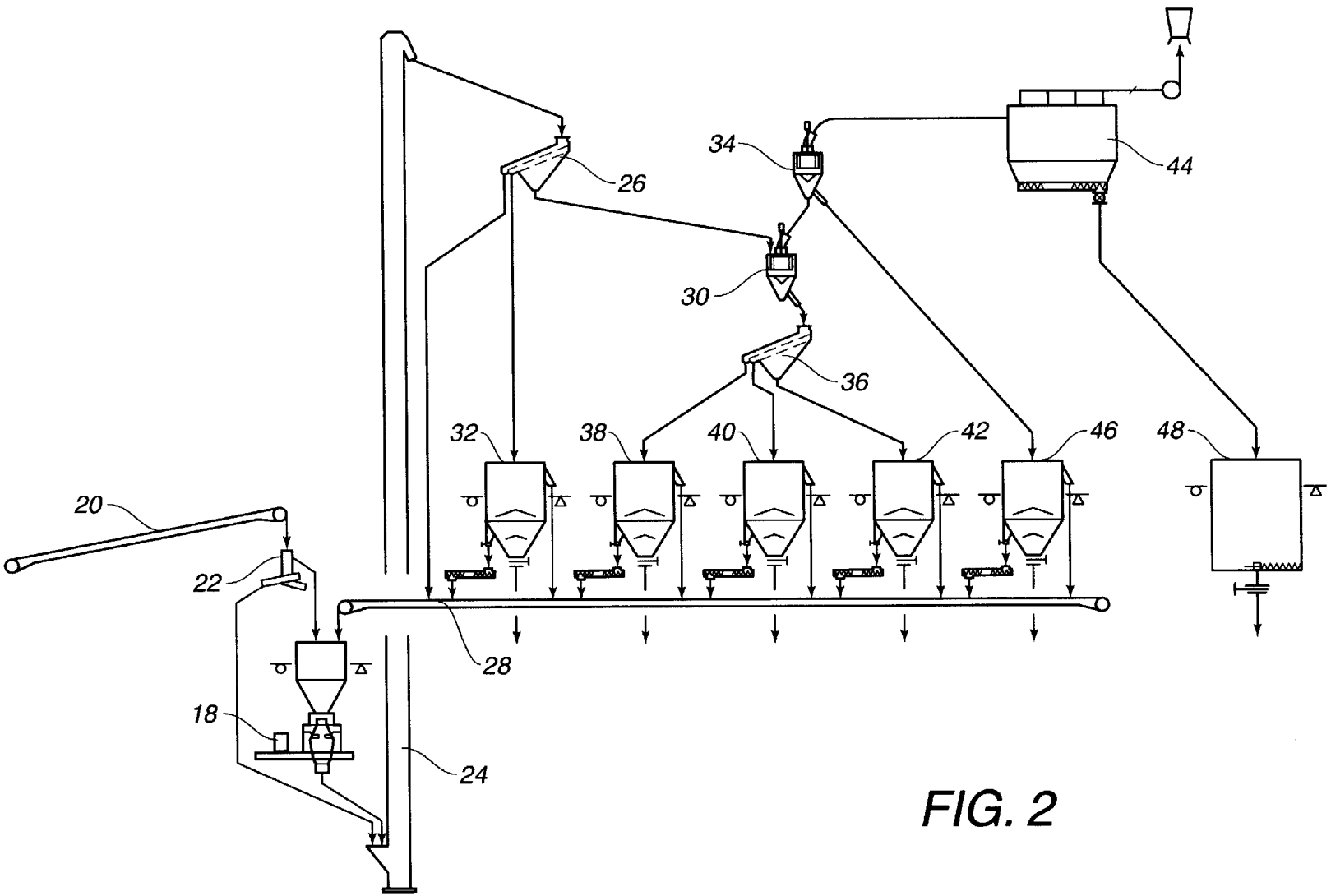
FIG. 2 is a diagrammatic illustration of a form of the present invention for the simultaneous production of six fractions of different grain sizes.

The plant represented by the diagram in FIG. 2 permits the simultaneous production of 6 fractions of different grain sizes. It is formed by a vibrating cone grinder 18 of the type described in French patents Nos. 93 03375 and 95 06964 in the name of the Applicant. The raw product is brought by a conveyor 20 which supplies the grinder via a dividing member 22 enabling one part of the raw product to short circuit the grinder. The product thus ground, as well as the fraction of the raw product short circuiting the grinder, are brought by an elevator 24 onto a two-cloth or grid screen 26.

The screen rejects are returned to the grinder input by means of a conveyor 28. The products passing through the two grids in the screen supply a pneumatic separator 30, which can be, for example, of the type described above with reference to FIG. 1. The intermediate grain size fraction is stored in a silo 32.

By way of example, the screen rejects can be constituted by pieces the dimensions of which are between 15 and 30 mm, the grains of the product supplying the separator 30 being of a size less than 15 mm.

In separator 30, the product is separated into a fine fraction, which is conveyed pneumatically to a second air type separator 34, and a coarse fraction, which supplies a two-cloth or grid screen 36 producing 3 fractions of different grain sizes, for example from 5 to 15 mm, from 1.5 to 5 mm and from 0.2 to 1.5 mm, which are stored in silos 38, 40 and 42, respectively.

In separator 34, the fine fraction is rid of the dusts (an ultra-fine fraction, for example less than 0.02 mm) which are recovered by means of a filter 44 ; the fine and ultra-fine fractions are stored in silos 46 and 48.

Silos 32, 38, 40, 42 and 46 are each provided with an overflow which supplies conveyor 28 enabling the production surplus, in relation to the needs for the different grain size fractions, to be returned to the grinder input.

When the silos have to work at a constant level, a lateral controlled extraction type lateral purging system placed at the bottom of silo is used to discharge the production surplus of each fraction and to ensure level regulation. The surpluses of each fraction are, in this case too, recycled to the grinder input.

Silo 48 used to store the ultra-fine fraction is not provided with either an overflow or a purging system, and a level regulator causes the plant de cease operation when the level of the products reaches an upper limit.

A regulating system is used to maintain at a predefined value the total throughput of the grinder by acting on the raw product feed rate. This system can comprise a grinder feed hopper maintained at a constant level or weight, or means for measuring the total throughput recycled to the grinder input.

Furthermore, the setting of the parameters determining the operating conditions of the grinder—output opening, vibration frequency, fragmentation force—and the setting the flow rate of the raw product short circuiting the grinder make it possible to optimize the grain size distribution of the ground product-raw product mixture supplied to the screen 26, so as to minimize the flow of products recycled to the grinder input.

Figure 3:
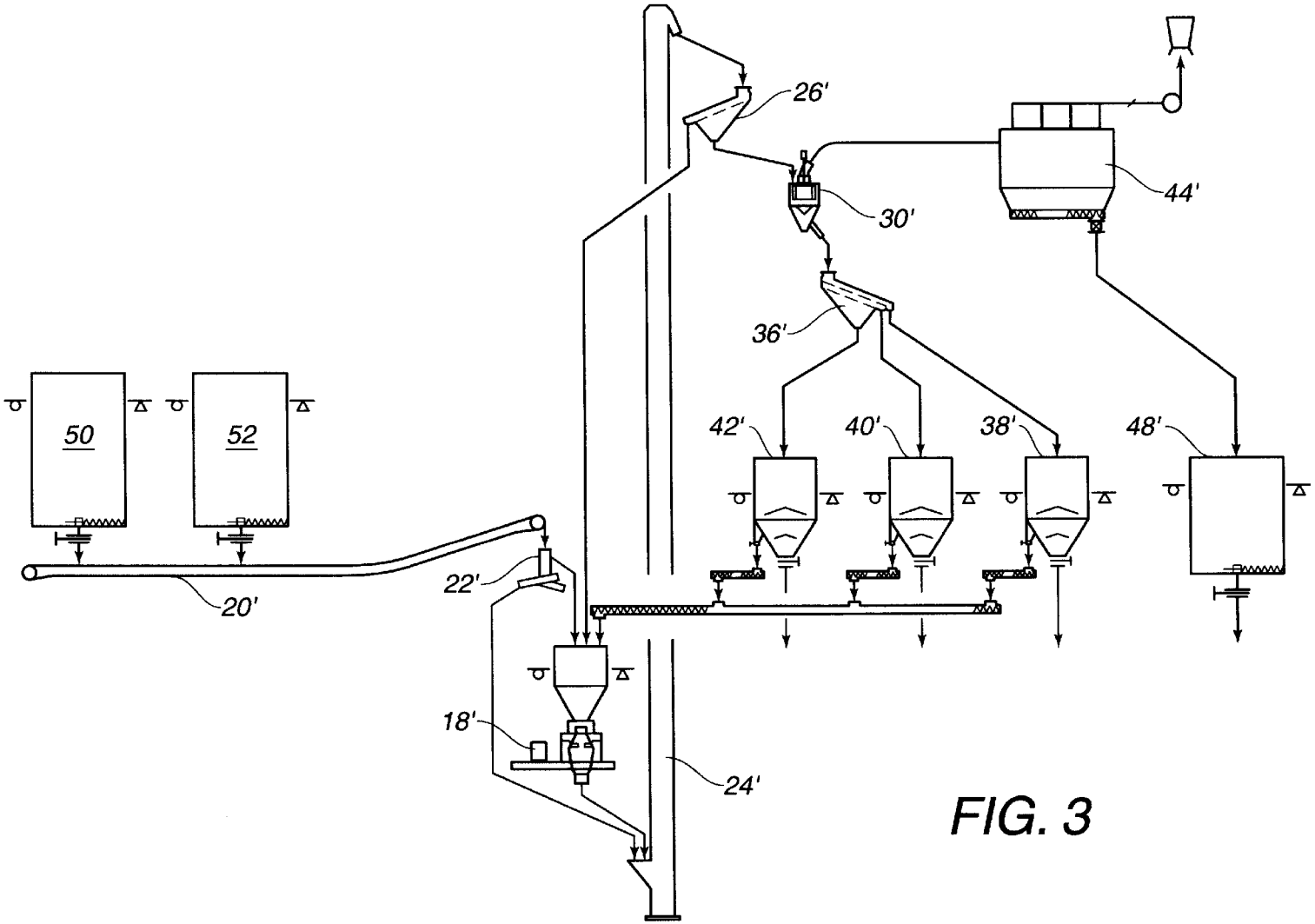
FIG. 3 is a diagrammatic illustration of the application of the present invention for the preparation of cake fractions.

The plant shown in FIG. 3 illustrates an application of the invention to the preparation of coke fractions for manufacturing the anodes used to produce aluminium by electrolysis; it can be used to produce four coke fractions of differing grain sizes.

This plant differs from that in FIG. 2 only in that the second air separator, 34 is dispensed with and in that, in place of screen 26, use is made of a screen 26' with only one cloth or grid.

From the coke taken from silos 50 and 52 and the pieces of which do not exceed 30 mm, this plant makes it possible to produce continuously four fractions formed of grains the dimensions of which are between 5 and 15 mm, 1.5 and 5 mm, 0.2 and 1.5 mm and less than 0.2 mm, and which are stored in silos 38', 40', 42' and 48', respectively.

Figure 4:
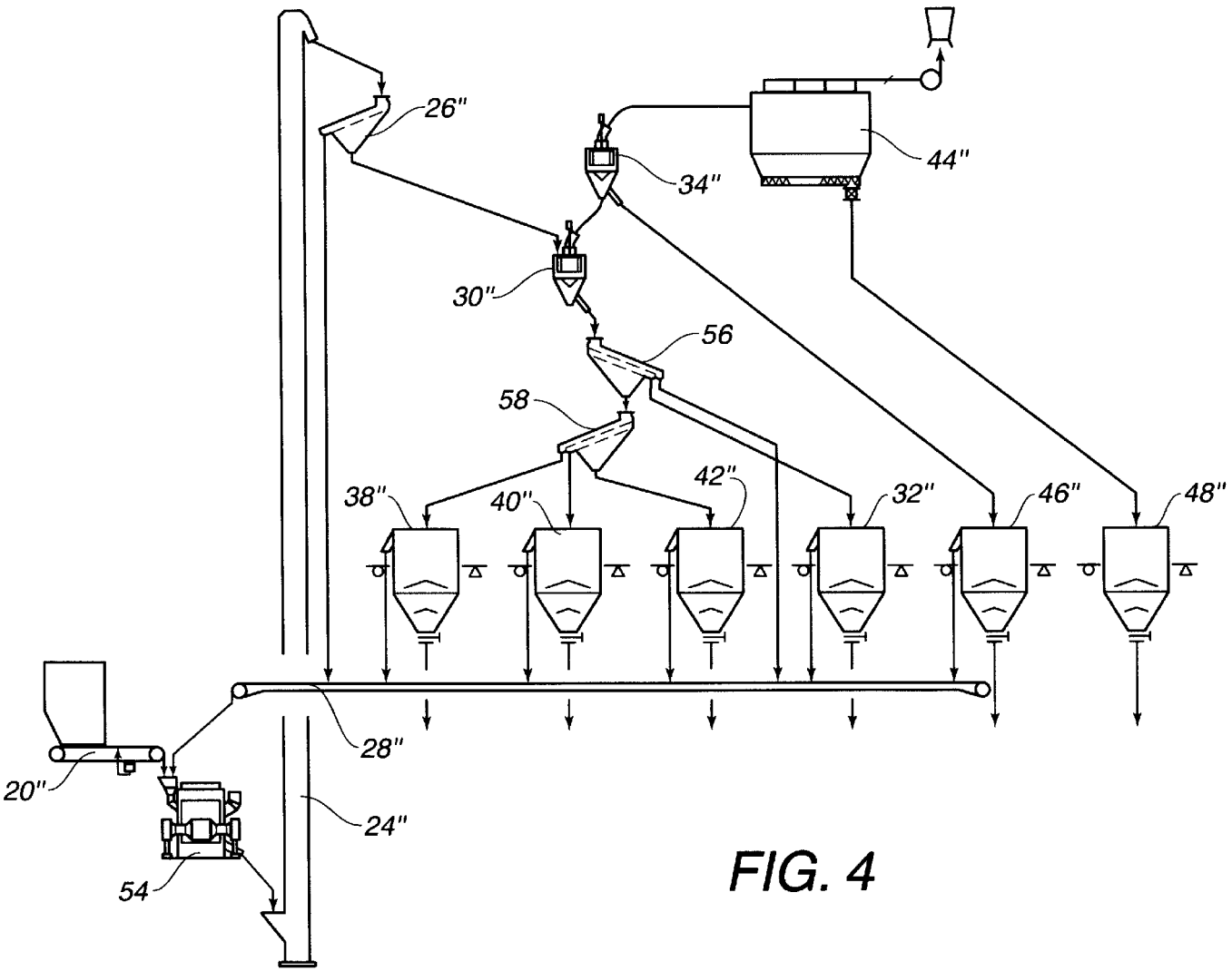
FIG. 4 is a diagrammatic illustration of the process of the present invention using a ring grinder.

In the plant in FIG. 4, the grinder 54 is a ring grinder of the type described above with reference to FIG. 1. The grinder feeds, by means of a bucket type elevator 24", a screen 26" the rejects of which are returned to the input of the grinder by a belt conveyor 28". The product passing through the screen is supplied to a pneumatic separator 30". The fine fraction pneumatically extracted from separator 30" is rid of the dusts (ultra-fine fractions) in a second pneumatic separator 34"; this ultra-fine fraction is separated from the stream of air by means of a filter 44" and stored in a silo 48", while the fine fraction (retained by the filter 34") is stored in a silo 46".

The separator 30" rejects are brought to a screen 56 having two grids or cloths. The screen rejects are discharged onto conveyor 28", the intermediate fraction is stored in a silo 32" and the fraction with a lower grain size, which has passed through the 2 grids in the screen 56 is supplied to a second screen 58, where it is divided into three new fractions which are stored in silos 38", 40" and 42", respectively.

This plant can be used, for example, to prepare mineral fillers. By equipping screen 26" with a 10 mm mesh grid, screen 56 with two cloths, of 1 and 2 mm mesh, and screen 58 with two cloths, of 0.3 and 0.5 mm, it is possible to produce, with this plant, six fractions the grain sizes of which will be between 1 and 2 mm, 0.5 and 1 mm, 0.3 and 0.5 mm, 0.1 and 0.3 mm, 0.02 and 0.10 mm and less than 0.02 mm, respectively.

The silos, with the exception of silo 48", are provided with overflows to enable the production surpluses of each grade to be returned to the grinder, by means of conveyor 28". A system for regulating the grinder feed rate enables it to be adapted to requirements. The setting of grinder parameters—the force applied to the roller, dwell time—enable grain size distribution of the ground product to be optimised so as to meet requirements.

Figure 5:
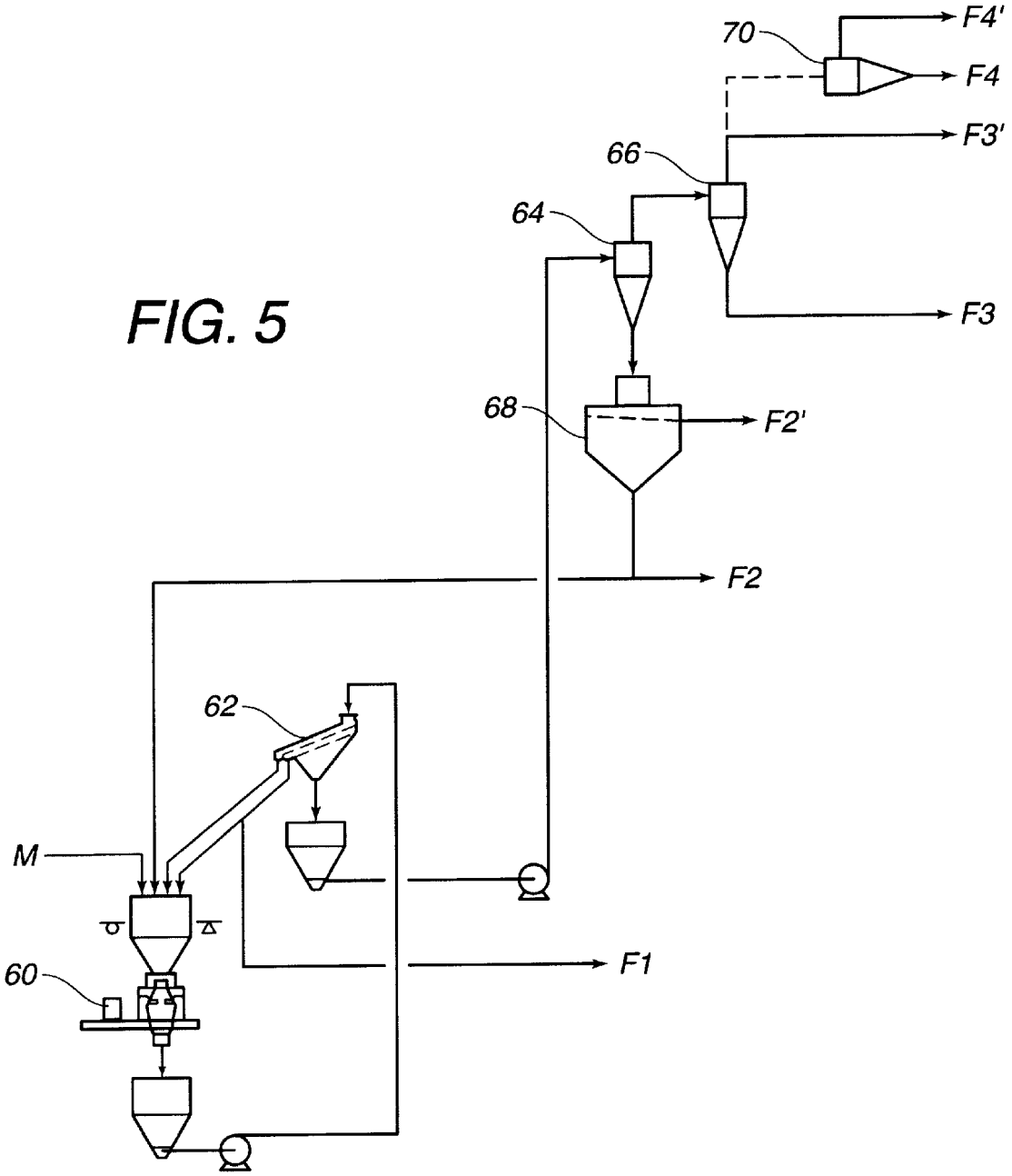
FIG. 5 is a diagrammatic illustration of the present invention in a form suitable for the processing of wet materials.

Unlike the plants described above, which process dry materials, the plant shown in the diagram in FIG. 5 can be used to process wet materials. It includes a grinder 60, for example a vibrating cone grinder, operating under wet conditions, a two-grid screen 62, two hydrocyclones, 64 and 66, and a hydraulic grading apparatus 68; pipes serve to interconnect these apparatus and pumps are used to circulate the products.

Raw product M is brought to the input of the grinder in the form of pulp or in pieces; in the latter case, water is added to the raw product in the grinder. The ground product is brought onto the screen 62. The screen rejects are returned to the grinder input. The product that has passed through the two grids of the screen is sent to the input to hydrocyclone 64. The fraction of the product formed by grains that have passed through the upper grid of screen 62, but which are larger than the mesh of the lower grid, undergo draining and/or filtering to remove part of the water, which is generally recycled. This fraction forms the coarse fraction F1 and part of it can be returned to the input to grinder 60.

The underflow of hydrocyclone 64 is supplied to hydraulic grading apparatus 68, while its overflow is sent to the input to hydrocyclone 66.

The overflow and the underflow of hydrocyclone 66 form two fine fractions F3 and F3' which are subjected, separately, to filtering or decanting to remove the water, which is recycled. The overflow of hydrocyclone 66 may possibly be processed by means of a centrifuge 70 giving two ultra-fine fractions, F4 and F4'.

In hydraulic grading apparatus 68, the underflow of hydrocyclone 64 is divided into two intermediate fractions, F2 and F2', which are also subjected to filtering to remove the water therefrom. Part of the underflow from grading apparatus 68 can, however, be returned to grinder 60 input.

It goes without saying that the plants described hereabove are merely non-limitative examples of applications of the invention and that many other implementations could be adopted without departing from the scope of the invention as defined by the claims.

I claim:

1. A process for comminuting by grinding a mineral material into grains of different sizes and dividing the ground mineral material into several fractions, the process comprising:

grinding pieces of a raw material with a single grinder by material layer crushing, said pieces having a grain size of no more than 150 millimeters;

dividing the ground pieces into at least three fractions of different grain sizes, each fraction having a grain size which lies between a predetermined upper limit and a predetermined lower limit, said three fractions having at least one coarse fraction and one fine fraction, said coarse fraction having a grain size of between 0.5 and 30 millimeters, said fine fractions having a grain size of between 30 and 300 micrometers;

returning grains of the divided ground pieces which are above an upper limit of the coarse fraction to an input of the grinder; and recirculating a production excess of one of said at least three fractions to said input of the grinder.

2. The process of claim 1, said step of recirculating comprising recirculating the production excess of a fraction between said coarse fraction and said fine fraction before recirculating the production excess of said coarse fraction.

3. An apparatus for comminuting comprising:

single material layer grinder adapted to a grind material;

at least two grading means for dividing the ground material layers into at least three fractions including at least one coarse fraction and one fine fraction, one of said grading means being connected to said grinder so as to receive the ground material, said one of said grading means for separating a grain size which is above an upper size limit of said coarse fraction from the ground material and for returning said grain size to an input of said grinder, another of said grading means connected to said grinder so as to receive the ground material from said grinder, said another of said grading means for separating said fine fraction from the ground material, each of said at least three fractions comprising grains having sizes which lie between a predetermined upper limit and a predetermined lower limit; and a return means connected to said at least two grading means, and return means for returning a production excess of at least one of said fractions to said input of said grinder.

4. The apparatus of claim 3, said one of said grading means being a screen.

5. The apparatus of claim 3, said one of said grading means being a hydraulic grading apparatus.

6. The apparatus of claim 3, said another of said grading means being a pneumatic separator.

7. The apparatus of claim 3, said another of said grading means being a hydrocyclone.

8. The apparatus of claim 3, said another of said grading means being a centrifuge.

* * * * *